United States Patent [19]

Malopolski, Jr.

[11] Patent Number: 4,663,801

[45] Date of Patent: May 12, 1987

[54] DOOR CHECK

[75] Inventor: William A. Malopolski, Jr., Roseville, Mich.

[73] Assignee: General Motors Corporation, Detroit, Mich.

[21] Appl. No.: 780,282

[22] Filed: Sep. 26, 1985

[51] Int. Cl.[4] ..... E05F 5/02

[52] U.S. Cl. ..... 16/82; 16/85; 16/292

[58] Field of Search ..... 16/82, 85, 292, 324

[56] References Cited

U.S. PATENT DOCUMENTS

| | | | |
|---|---|---|---|
| 2,513,751 | 7/1950 | Semar . | |
| 2,779,050 | 1/1957 | Semar . | |
| 3,051,983 | 9/1962 | Dale | 16/82 |
| 3,369,833 | 2/1968 | Schaldenbrand | 16/82 |

*Primary Examiner*—Leonidas Vlachos

*Attorney, Agent, or Firm*—Patrick M. Griffin

[57] ABSTRACT

A door check provides a positive stop at a hold open position, as well as being disengageable to provide a fully open position, and is automatically reengageable upon door closing. A check strap is pivotally mounted to a vehicle body and resiliently biased into sliding engagement with a stop pin fixed to the vehicle door. As the door is opened, the stop pin slides along a working surface of the check strap, and into a catch portion hook to block the stop pin and provide a positive stop to maintain the door at a hold open position. The door may be moved back toward closed position to move the stop pin out of the hook, and the check strap moved by an external force away from the stop pin enough that the stop pin will miss the hook as the door is moved back to the hold open position. From there, the door can be moved to a fully open position, as the stop pin slides along the surface of a keeper portion on the check strap. The keeper portion surface is oriented so that the stop pin will slide over the catch portion and automatically back into engagement with the working surface under the resilient bias as the door is closed.

3 Claims, 6 Drawing Figures

DOOR CHECK

This invention relates to door checks generally and specifically to a disengageable and automatically reengageable positive stop door check.

BACKGROUND OF THE INVENTION

In hingedly supported vehicle doors, such as the rear door of a van, it is common to provide a door check that will maintain the door at a hold open position of approximately 90 degrees. It is desirable that the door check provide a positive stop at the hold open position, that is, to assure that the door check blockingly engages a stop member of some sort to maintain the door at the hold open position. It is also desirable, however, to be able to move the door farther to a fully open position beyond the hold open position, clear of a wide item to be loaded.

Door checks that provide a positive stop are known. An example may be seen in the U.S. Pat. No. 2,779,050 to Semar. As disclosed there, a check strap 26 pivoted to a body structure 10 has a hooked portion 30 that blockingly engages a stop pin 42 on the vehicle door 11. That blocking engagement maintains the door positively at a hold open position, but there is no means provided to allow the check strap 26 to be disengaged so that the door 11 may be fully opened. Disengageable door checks are known. A disengageable door check may be seen in FIGS. 5 and 6. A door check designated generally at A is used with a swingable door B, such as the rear door of a van vehicle C. FIG. 6 shows the relative position of a stop member D to door check A when door B is in an intermediate hold open position. Stop member D, a pin, is releaseably held in a resilient detent E. Door check A may be easily disengaged simply by moving door B to the fully open position, which moves pin D out of detent E to the dotted line position. However, it will be readily understood that pin D is not positively stopped at the hold open position. Door B would be maintained in the hold open position only in proportion to the strength of detent E.

SUMMARY OF THE INVENTION

The subject invention provides a door check that does provide a positive stop at the hold open position, but that may be disengaged to allow the door to be fully opened, and that is automatically reengageable, as well.

A vehicle has a door hingedly supported on a body structure so as to be movable about an axis between a closed position and a fully open position. A stop member is supported on either the door or the body structure and thereby moves in an arc relative to either the body structure or the door as the door moves about the axis. In the preferred embodiment disclosed, the stop member is a stop pin fixed to the vehicle door.

A check strap having first and second ends is movably supported at the first end to either the body structure or the door. In the preferred embodiment, the check strap is a rigid strap pivoted at its first end to the body structure. The check strap includes a working surface, with which the stop pin is slideably engageable, that extends from near the first end to a catch portion intermediate the first and second ends. The catch portion is a resilient hook that is sized to as to be capable of capturing the stop pin to thereby blockingly engage it. The catch portion hook is cooperatively formed, in part, by a stop flange that is normal to the working surface and that has a height sufficient to just partially block the stop pin, and is thus easily formed.

The check strap also includes a keeper portion that has a surface that extends substantially from the check strap second end and with which the stop pin is slideably engageable. In the preferred embodiment, the keeper portion extends closely over and beyond the stop flange to a free end that is spaced from the check strap working surface by substantially the width of the stop pin. Thus, the keeper portion and stop flange cooperate to form a hook within which the stop pin is capturable so as to be blockingly engaged. Furthermore, the free end of the keeper portion is flexible relative to the check strap working surface, so the cooperatively formed catch portion hook is resilient. The keeper portion free end also includes a convex portion facing the check strap working surface and spaced therefrom by less than the width of the stop pin. The convex portion has a matching concave portion facing away therefrom and merging with the keeper portion surface. The stop pin is also slideably engageable with the concave portion, which is sized so that stop pin may be cradled therewithin. The keeper portion surface is thus oriented so that it will direct the stop pin through the concave portion and over the free end that cooperatively forms the catch portion hook as the stop pin slides along the keeper portion surface toward the check strap first end. A resilient coil spring continually biases the check strap about its pivoted first end so as to maintain one of the check strap working surface, the concave portion, or the keeper portion surface slideably engaged with the stop pin as the door moves.

When the door is in the closed position, the stop pin is engaged with the check strap working surface under the bias of the spring. As the door is moved by the operator of the door from the closed toward the fully open position, the stop pin slides along the working surface, moving in a direction from the first end toward the catch portion. In the preferred embodiment disclosed, the stop pin slides along the working surface until it moves beneath the free end of the keeper portion and snaps past the convex portion and against the stop flange. Thus, the stop pin is resiliently captured within in and blockingly engaged by the hook that comprises the catch portion. This blocking engagement maintains the door at a hold open position intermediate the closed and fully open positions.

When the door is in the hold open position, the door check of the invention may be disengaged to allow the door to be moved farther to the fully open position. First, the door is moved back toward the closed position sufficiently to move the stop pin from beneath the free end of the keeper portion, and thus out of and away from the catch portion hook. Then, the check strap is rotated by an external force about the pivoted first end in opposition to the biasing spring. The check strap is so moved until the working surface has been moved away from the stop pin sufficiently that, when the door is moved back approximately to the hold open position, the stop pin will miss the free end of the keeper portion, and thus miss the catch portion hook.

Next, the check strap is released, and the biasing spring rotates the check strap back to slideably engage the stop pin with the keeper portion surface. In the preferred embodiment disclosed, the stop pin will be cradled within the concave portion. From that point, the door may be opened farther to the fully open position. As the door opens farther, the stop pin simultaneously slides out of the concave portion, along the keeper portion surface, and toward the second end of the check strap. When the door is moved from the fully open position back toward the closed position, the stop pin slides back along the keeper portion surface from the second end toward the catch portion hook. Because of the orientation of the keeper portion surface, the stop pin slides through the concave portion, and over the free end of the keeper portion that cooperatively forms the catch portion hook. The stop pin thus moves automatically back into engagement with the check strap working surface under the force of the biasing spring.

It is, therefore, an object of the invention to provide a disengageable and automatically reengageable positive stop door check for a door hingedly supported on a body structure to move about an axis between a closed and a fully open position that has a stop member supported on either the door or the body structure and movable relative to either the body structure or the door when the door is moved about the axis and a two ended check strap that is movably supported at a first end on the body structure or the door and that has a working surface that extends from substantially the first end to a catch portion that is intermediate the first and second ends and that is blockingly engageable with the stop pin, and in which the check strap also has a keeper portion with a surface slideably engageable with the stop member that extends substantially from the check strap second end to the catch portion and oriented so as to direct the stop member over the catch portion as the stop member slides in that direction along the keeper portion surface, and a resilient means that continually biases the check strap about its movably supported first end to maintain either the check strap working surface or the keeper portion surface slideably engaged with the stop member as the door so moves, whereby the door can be moved from its closed toward its fully opened position, thereby causing the stop member to slide along the check strap working surface from the first end toward the second end until the stop member blockingly engages the catch portion, which provides a positive stop that maintains the door at a hold open position intermediate the closed and fully open positions, while from the hold open position the door can be moved toward the closed position sufficiently to move the stop member away from the catch portion so that the check strap may then be moved by an external force about its first end, against the bias of the resilient means, to move the working surface away from the stop member sufficiently that the stop member will miss the catch portion when the door is moved back substantially to the hold open position, at which point the external force on the check strap may be released, which slideably engages the stop member with the keeper portion surface, so that the door may then be opened farther to the fully open position as the stop member slides along the keeper portion surface toward the second end of the check strap, from which point the door may be moved back toward the closed position as the stop member slides back along the keeper portion surface from the second end, over the catch portion, and automatically reengages the check strap working surface.

It is another object of the invention to provide a door check of the type described for the same type of body structure and a door movable in the same fashion in which the stop member is stop pin and in which the catch portion of the check strap is a resilient hook that has a convex portion facing the check strap working surface and spaced therefrom by less than the width of the stop pin, with a matching concave portion facing away from the working surface with which the stop pin is slideably engageable and sized so as to cradle the stop pin, and in which the surface of the keeper portion of the check strap extends to the concave portion of the hook, so that the stop pin may move past the convex portion of the hook as the door is opened to be resiliently captured within the hook and blockingly engaged thereby to provide a positive stop at the hold open position, and so that the matching concave portion of the hook can cradle the stop pin after the stop pin has been moved out of the hook and the external force on the check strap has been released prior to moving the door further to the fully open position, with the stop pin sliding along the keeper portion surface, through the concave portion and over the hook to automatically reengage the check strap when the door is moved from the fully open position back toward the closed position.

It is yet another object of the invention to provide a door check of the type described for the same type body structure and a door movable in the same fashion in which the check strap has a stop flange intermediate its first and second ends that is substantially normal to the working surface with a height sufficient to partially block the stop pin, and in which the keeper portion extends from the check strap second end and closely over and beyond the stop flange to a free end spaced from the working surface by substantially the width of the stop pin to thereby form a hook in cooperation with the stop flange within which the stop pin is capturable so as to be blockingly engaged to provide a positive stop at the hold open position, and in which the keeper portion surface with which the stop pin is slideably engageable extends from substantially the check strap second end to the keeper portion free end so that the stop pin will slide along the keeper portion surface and over the free end to automatically reengage the working surface when the door is moved from the fully open position back toward the closed position.

DESCRIPTION OF THE PREFERRED EMBODIMENT

These and other objects and features of the invention will appear from the following written description and drawings in which.

Figure 1:
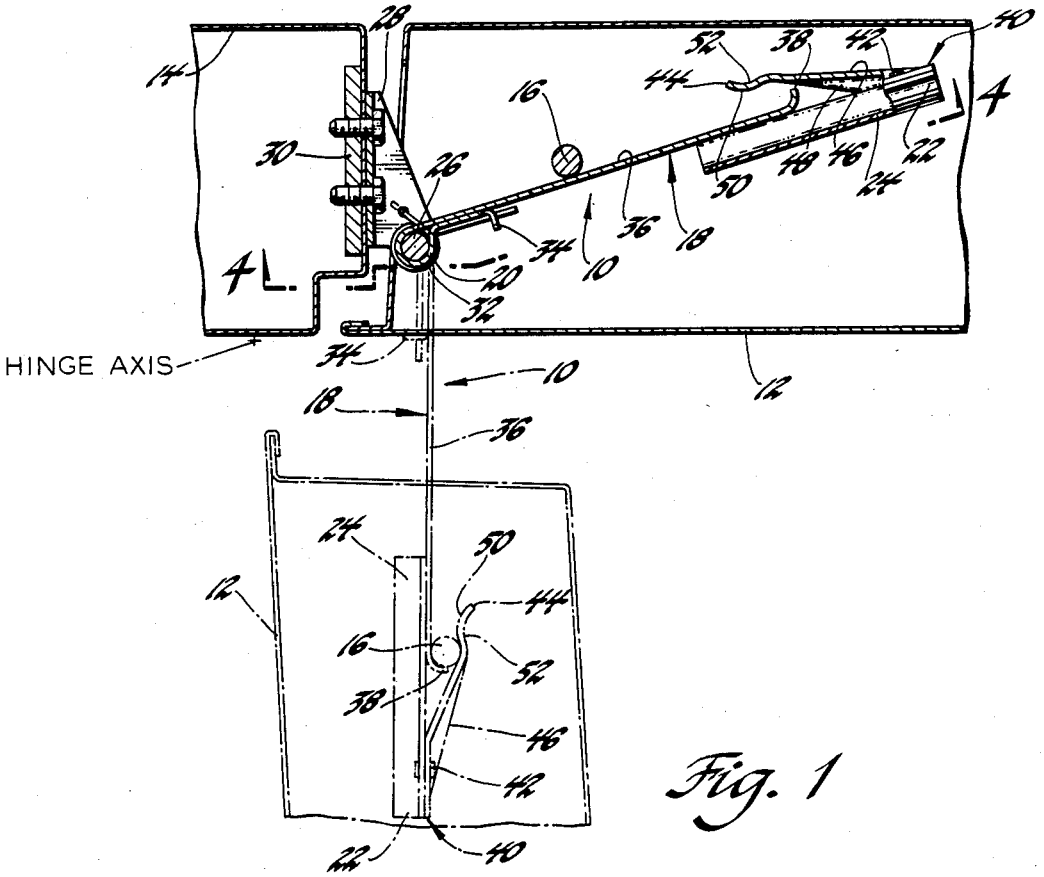
FIG. 1 is a sectional view of the door, body structure and the door check of the invention, showing the door in the closed position and in the hold open position in dotted lines.
Figure 3:
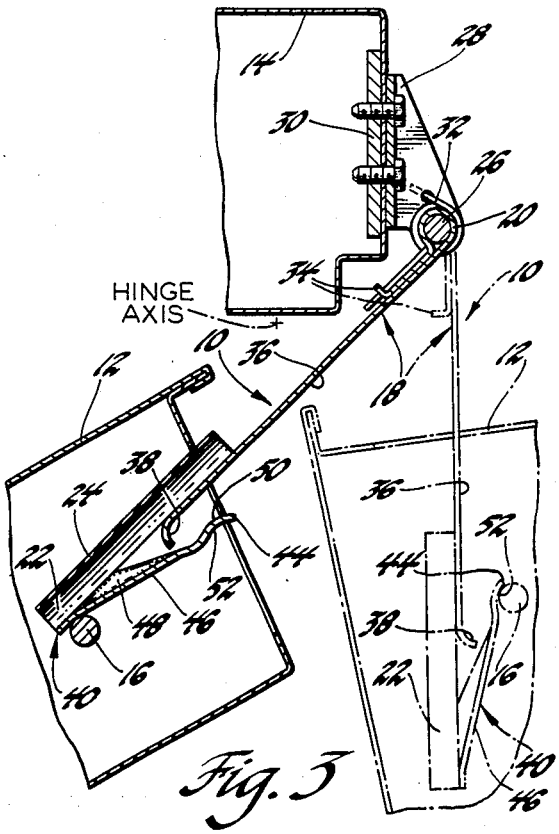
FIG. 3 is a sectional view similar to FIG. 2, but showing the door moved back substantially to the hold open position with the check strap released, and showing the door moved to the fully open position in solid lines.
Figure 4:
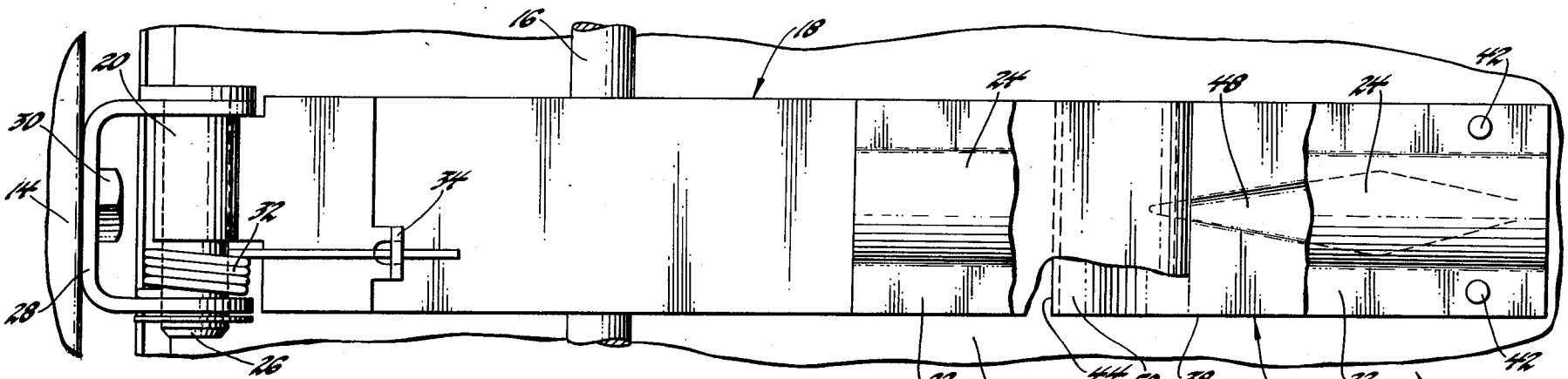
FIG. 4 is a plan view of the rear of the door check partially broken away.
Figure 6:
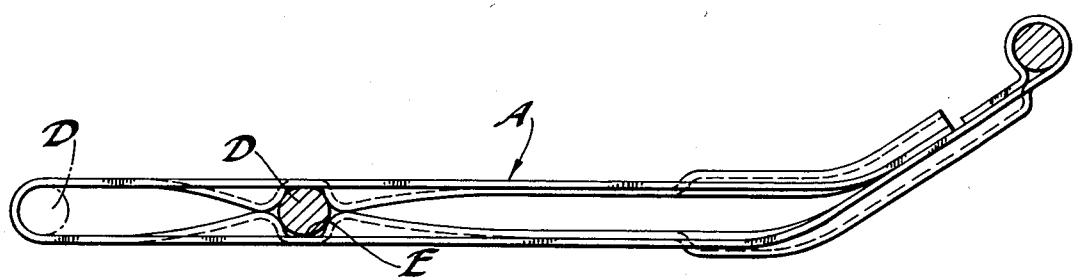
PRIOR ART Fig. 6
FIG. 6 is a view along the line 6—6 of FIG. 5.
Figure 5:
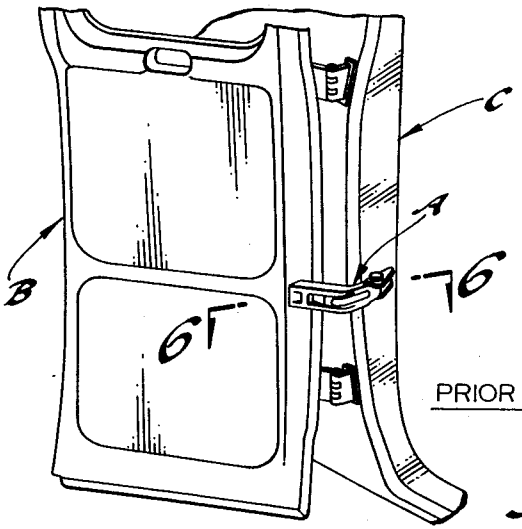
PRIOR ART Fig. 5
FIG. 5 is a perspective view of a door and vehicle incorporating a prior art door check.

Referring first to FIGS. 1 and 4, the door check of the invention is designated generally at 10. Door check 10 is disclosed for use with a door 12, such as the rear door of a van, that is hingedly supported on a body structure 14. This environment is similar to that in FIG. 5. Door 12 moves in a swinging arc about the labeled hinge axis, and is shown in a fully closed position in solid lines. It is generally desirable that the door be positively stopped at an approximately 90 degree intermediate or hold open position, shown in dotted lines. Door check 10 provides such a positive stop. It is also desirable, however, that door 12 be movable to a fully open position beyond the hold open position, shown in FIG. 3 in solid lines, so that door 12 will be clear of any wide item that is to be loaded. Door check 10 is disengageable at the hold open position so as to provide the fully open position, but is also automatically reengageable as door 12 is closed.

Referring again to FIGS. 1 and 4, a stop member, which is a steel cylindrical stop pin 16, is fixedly supported within the structure of door 12, generally parallel to the hinge axis. As a consequence, stop pin 16 moves in an arc relative to body structure 14 about the same hinge axis when door 12 is moved. Stop pin 16 could be fixedly supported within the structure of body structure 14 instead, and would then move relative to door 12. While it is this relative movement that is important, it is more convenient that stop pin 16 be supported on door 12. A different shape can be substituted for stop pin 16, as long as it cooperates with the other elements of door check 10 as described below. It is practical, however, that the stop member have at least the general shape of stop pin 16 with a diameter, or width, similar to the that of stop pin 16.

Still referring to FIGS. 1 and 4, a two-ended check strap designated generally at 18 is a rigid steel stamping. A closed loop 20 of less width that check strap 18 forms the first end of check strap 18 and an extension 22 of similar width welded thereto forms its second end. As best seen in FIG. 4, extension 22 is also a steel stamping, and has a central strengthening rib 24 stamped thereinto. Check strap 18 could be formed as a unitary stamping without extension 22, but extension 22 provides an advantage described further below. Check strap 18 is movably supported on body structure 14 by a pivot pin 26 through loop 20. Pivot pin 26 passes through the legs of a U-shaped support bracket 28 that is fixed to body structure 14 by a bolt and anchor plate assembly 30. Pivot pin 26 is also substantially parallel to the hinge axis, and allows check strap 18 to pivotally move toward and away from the stop pin 16. A resilient means in the form of a spring 32 wraps around pivot pin 26 in the space left by the less wide loop 20 and is fixed through a tab 34 on check strap 18. Spring 32 continually biases check strap 18 so as to pivot it toward stop pin 16. Other means of pivoting the first end of check strap 18 may be used. In addition, forming check strap 18 of inherently resilient spring steel would allow it to move similarly about its first end with the same continual bias, but without the need of a pivotal mount or a separate spring. The pivotal mount disclosed, however, is convenient and practical.

Referring to FIG. 1, check strap 18 has a working surface 36 on the side that faces stop pin 16, extending from near loop 20 to an integral stop flange 38. When door 12 is at a position between the closed and the fully open positions, working surface 36 is maintained in sliding engagement with stop pin 16 by the continual bias of spring 32. A stop flange 38 intermediate the ends of check strap 18 is substantially normal to working surface 36, and has a height that is less than the diameter of stop pin 16. As such, stop flange 38 is not by itself capable of capturing and blockingly engaging stop pin 16, as would a complete, or 180 degree, hook. Stop flange 38 does, however, cooperate with other structure to effectively and advantageously form a catch portion hook, as will be described below.

Referring now to FIGS. 1 and 4, check strap 18 also includes a keeper portion, which is a separate stamped steel keeper designated generally at 40 that is attached in cantilever fashion by rivets 42 to the extension 22 second end of check strap 18. Keeper 40 extends from near the rivets 42 closely over and beyond stop flange 38 to a free end 44 that is spaced from working surface 36. Therefore, keeper 40 cooperatively forms with stop flange 38 a hook that serves as a catch portion within which stop pin 16 may be captured, as will be fully described below. The outer surface 46 of keeper 40 also extends from the rivets 42 and stop pin 16 is slideably engageable therewith. Surface 46 also has a strengthening rib 48 stamped into it. Rivets 42 do not give an absolutely rigid attachment of keeper 40 to extension 22, and free end 44 may thereby flex slightly toward and away from working surface 36. The cooperatively formed catch portion hook is, therefore, resilient. Furthermore, free end 44 is stamped with a curved bend that has a convex portion 50 facing working surface 36 with an oppositely facing matching concave portion 52 that merges with keeper outer surface 46. Convex portion 50 is spaced from working surface 36 by less than the width of stop pin 16 to take advantage of the flexibility of free end 44, as will be described below. Concave portion 52 has a relatively shallow curvature that will not block stop pin 16 from sliding through it, but it is sized such that stop pin 16 may rest or cradle therewithin. These features lead to advantages best described below in describing the operation of the invention.

Referring again to FIG. 1, when door 12 is initially moved from the solid line fully closed position, stop pin 16 slides along check strap working surface 36 in the direction from the first end of check strap 18 toward the catch portion hook formed by keeper free end 44 and stop flange 38. Check strap 18 pivots clockwise about pivot pin 26 against the force of spring 32 until stop pin 16 moves beneath keeper free end 44 and against stop flange 38 to be captured. It will be understood that by being so captured, stop pin 16 is blockingly engaged, that is, it cannot move farther past stop flange 38, just as if it were captured within a completely closed hook. Thus, a positive stop is provided, and door 12 is thereby maintained at the dotted line hold open position, approximately 90 degrees open. Furthermore, as stop pin 16 moves against stop flange 38, it snaps past and is resiliently captured by convex portion 50, due to its spacing and the flexibility of free end 44 described above.

Variations in the preferred embodiment are possible. Stop pin 16 could be resiliently captured by an inherently resilient complete or closed hook, rather than the cooperatively formed catch portion hook disclosed. Furthermore, the keeper portion of check strap 18 could, as the name implies, be separate from and play no part in forming the catch portion hook. However, the keeper 40 disclosed, and its cooperation with stop flange 38, provide several advantages. First, it is easier from a manufacturing standpoint to form the relatively short stop flange 38 and to extend the the keeper 40 over it than it would be to bend and form a closed hook. Stop flange 38 is formed simply by bending out the end of the steel that provides the working surface 36, with extension 22 providing the second end of check strap 18. Secondly, a resilient or flexible closed hook would be stressed about its bend as it flexed. In the preferred embodiment disclosed, the flexing of free end 44 is allowed by the partially flexible rivet 42 connection between two otherwise separate pieces, extension 22 and keeper 40. That connection may be more easily controlled and varied, and the bending stress may be more easily absorbed, than with a closed hook. In effect, the catch portion hook disclosed is already broken at the very point that a closed hook would be most stressed. Third, cooperatively forming the catch portion hook with keeper 40 assures that the orientation of keeper outer surface 46 is such that it will direct stop pin 16 through concave portion 52, over free end 44, and thus over the cooperatively formed catch portion hook. It would also be possible to capture stop pin 16 in a non-resilient hook by spacing keeper free end 44 from working surface 36 by approximately the same width as stop pin 16, but without the matching convex and concave portions 50 and 52. However, the resilient capture provided by convex portion 50 helps to maintain door 12 against closing when in the hold open position, although not in the positive fashion that it is maintained against further opening. Furthermore, there is an additional advantage to forming free end 44 with the matching convex and concave portions 50 and 52, described next.

Figure 2:
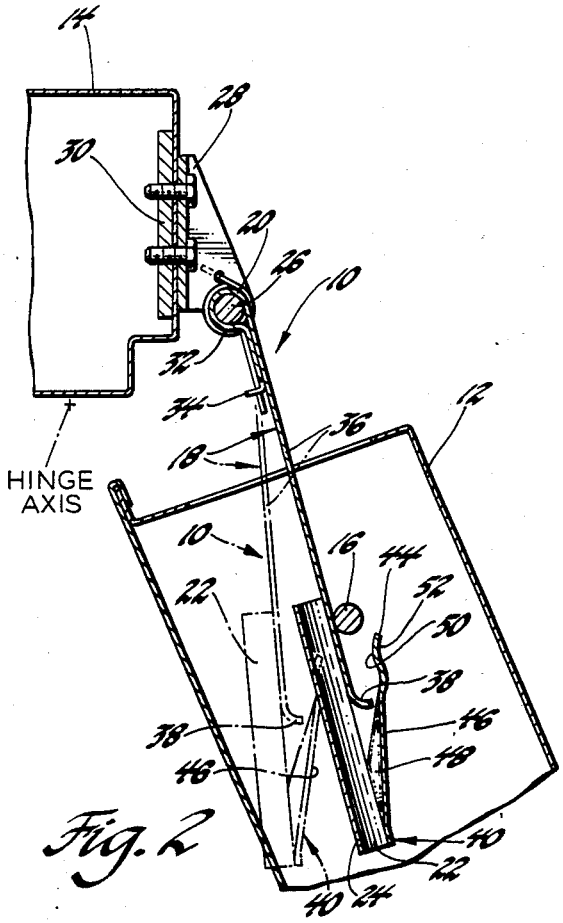
FIG. 2 is a sectional view as in FIG. 1, but showing the door moved from the hold open position toward the closed position sufficiently to move the stop member out of the catch portion, and showing the check strap moved away from the stop member in dotted lines.

Referring next to FIGS. 1 through 3, door 12 may be moved from the hold open position of FIG. 1 back toward the closed position sufficiently to move stop member 16 out from under keeper free end 44, as seen in solid lines in FIG. 2. At that point, check strap 18 may be moved clockwise by an external force against the bias of spring 32 to the dotted line position of FIG. 2, moving stop pin 16 away from working surface 36. That external force is conveniently provided by the door operator simply pushing on check strap 18, although it could be provided otherwise. The external force on check strap 18 is maintained and stop pin 16 is kept sufficiently spaced from working surface 36 so that, as door 12 is moved from the solid line position of FIG. 2 back to approximately the hold open position, stop pin 16 will miss the keeper free end 44. This position is shown in dotted lines in FIG. 3. At that point, the external force on check strap 18 may be released, and the bias of spring 32 will pivot it back counterclockwise to slideably engage and be cradled within the concave portion 52 formed in keeper free end 44. Had the door 12 been moved farther toward the fully open position when the external force on check strap 18 was released, then stop pin 16 would have engaged keeper outer surface 46 at a point closer to rivets 42. That would be a stable position for stop pin 16, since surface 46 slopes away from free end 44. However, the concave portion 52 also stabilizes stop pin 16, which a differently formed hook with a convex outer surface would not do. This cradling feature is achieved essentially for free, as a by product of forming the convex portion 50 that gives the resilient capture of stop pin 16.

Referring still to FIG. 3, door 12 may now be opened farther, from the dotted line position of FIG. 3 to the fully open solid line position. As door 12 so moves, stop pin 16 slides out of concave portion 52, along keeper outer surface 46 and toward the check strap second end of extension 22. During this motion, stop pin 16 and keeper outer surface 46 are maintained in sliding engagement by the continual bias of spring 32. At the fully open solid line position of FIG. 3, it will be seen that door 12 is clear of any wide item that it would be desired to load. The opening motion just described may be easily reversed. From the fully open position, door 12 may be moved back toward the closed position of FIG. 1. As door 12 is so moved, stop pin 16 will slide along keeper outer surface 46 and back into concave portion 52, as shown in dotted lines in FIG. 3. Stop pin 16 will slide through concave portion 52 and then over keeper free end 44 and into reengagement with working surface 36 in one continuous closing motion of door 12. This reengagement occurs automatically under the bias of spring 32. From the solid line position of FIG. 2 where stop pin 16 is so reengaged, it will slide back along check strap working surface 36 to the solid line position of FIG. 1.

Variations of the preferred embodiment disclosed may be made with the spirit of the invention. The cooperatively formed hook disclosed is just one type of catch portion possible, one that provides the additional advantages described. Any catch portion that blockingly engaged the stop member as it slid along the check strap working surface would still provide a positive stop. And any keeper portion that had a surface oriented so as to direct the stop member over the catch portion as the door was closed would provide the automatic reengagement. Therefore, it will be understood that the invention is not intended to be limited to the preferred embodiment disclosed.

The embodiments of the invention in which an exclusive property or privilege is claimed are defined as follows:

1. A disengageable and automatically reengageable positive stop door check for a door hingedly supported on a body structure to move about an axis between a closed and a fully open position, comprising in combination;

a stop member supported on one of said door and body structure and movable relative to the other of said door and body structure about said axis as said door moves about said axis, a check strap having a first and second end and movably supported at said first end on the other of said door and body structure, said check strap including a working surface with which said stop member is slideably engageable extending substantially from said first end to a catch portion intermediate said first and second end, said catch portion being blockingly engageable with said stop member, said check strap further including a keeper portion having a surface that is slideably engageable with said stop member and extends substantially from said second end to said catch portion and oriented so as to direct said stop member over said catch portion as said stop member slides along said keeper portion surface from said second end toward said first end, and, resilient means continually biasing said check strap about said movably supported first end so as to maintain one of said check strap working surface and keeper portion surface continually slideably engaged with said stop member as said door moves, whereby, as said door is moved from said closed toward said fully open position, said stop member slides along said check strap working surface from said first end toward said catch portion until said stop member blockingly engages said catch portion to provide a positive stop to maintain said door at a hold open position intermediate said closed and fully open positions, said door being movable from said hold open position toward said closed position sufficiently to move said stop member away from said catch portion, said check strap then being movable by an external force about said first end against the bias of said resilient means to move said working surface away from said stop member sufficiently that said stop member will miss said catch portion as said door is moved back substantially to said hold open position, at which point the external force on said check strap may be released to slideably engage said stop member with said keeper portion surface so that said door may be opened farther to said fully open position as said stop member slides along said keeper portion surface toward said second end, said door then being movable back toward said closed position as said stop member slides back along said keeper portion surface from said second end and over said catch portion to thereby automatically reengage said check strap working surface under the bias of said resilient means.

2. A disengageable and automatically reengageable positive stop door check for a door hingedly supported on a body structure to move about an axis between a closed and a fully open position, comprising in combination;

a stop pin supported on one of said door and body structure and movable relative to the other of said door and body structure about said axis as said door moves about said axis, a check strap having a first and second end and movably supported at said first end on the other of said door and body structure, said check strap including a working surface with which said stop pin is slideably engageable extending substantially from said first end to a resilient hook intermediate said first and second end, said hook being formed with a convex portion facing said working surface and spaced therefrom by less than the width of said stop pin so that said stop pin is resiliently capturable within said hook so as to be blockingly engaged thereby, said hook further including a concave portion facing away from said working surface with which said stop pin is slideably engageable and sized so as to cradle said stop pin, said check strap further including a keeper portion having a surface that is slideably engageable with said stop pin and extends substantially from said second end to said hook concave portion so as to direct said stop pin through said concave portion and over said hook as said stop pin slides along said keeper portion surface from said second end toward said first end, and, resilient means continually biasing said check strap about said movably supported first end so as to maintain one of said check strap working surface, keeper portion surface, and hook concave portion slideably engaged with said stop pin as said door moves, whereby, as said door is moved from said closed toward said fully open position, said stop member slides along said check strap working surface from said first end toward said hook until said stop member moves past said hook convex portion to be resiliently captured within and blockingly engaged by said hook to provide a positive stop to maintain said door at a hold open position intermediate said closed and fully open positions, said door being movable from said hold open position toward said closed position sufficiently to move said stop pin out of said hook, said check strap then being movable by an external force about said first end against the bias of said resilient means to move said working surface away from said stop pin sufficiently that said stop pin will miss said hook as said door is moved back substantially to said hold open position, at which point the external force on said check strap may be released to cradle said stop pin within said hook concave portion, said door then being movable farther to said fully open position as said stop pin slides out of said hook concave portion and along said keeper portion surface toward said second end, said door then being movable back toward said closed position as said stop pin slides back along said keeper portion surface from said second end, through said concave portion and over said hook to thereby automatically reengage said check strap working surface under the bias of said resilient means.

3. A disengageable and automatically reengageable positive stop door check for a door hingedly supported on a body structure to move about an axis between a closed and a fully open position, comprising in combination;

a stop pin supported on one of said door and body structure and movable relative to the other of said door and body structure about said axis as said door moves about said axis, a check strap having a first and second end and movably supported at said first end on the other of said door and body structure, said check strap including a working surface with which said stop pin is slideably engageable extending substantially from said first end to a stop flange intermediate said first and second end that is substantially normal to said working surface and has a height sufficient to partially block said stop pin, said check strap further including a keeper portion extending substantially from said check strap second end and closely over and beyond said stop flange to a free end spaced from said check strap working surface by substantially the width of said stop pin to thereby form a hook in cooperation with said stop flange within which said stop pin is capturable so as to be blockingly engaged thereby, said keeper portion further including a surface with which said stop member is slideably engageable extending substantially from said check strap second end to said keeper portion free end, and, resilient means continually biasing said check strap about said movably supported first end so as to maintain one of said check strap working surface and keeper portion surface slideably engaged with said stop member as said door moves, whereby, as said door is moved from said closed toward said fully open position, said stop member slides along said check strap working surface from said first end toward said catch portion until said stop member moves beneath said keeper portion free end and against said stop flange so as to be captured and blockingly engaged to provide a positive stop to maintain said door at a hold open position intermediate said closed and fully open positions, said door being movable from said hold open position toward said closed position sufficiently to move said stop member from beneath said keeper portion free end, said check strap then being movable by an external force about said first end against the bias of said resilient means to move said working surface away from said stop pin sufficiently that said stop pin will miss said keeper portion free end as said door is moved back substantially to said hold open position, at which point the external force on said check strap may be released to slideably engage said stop pin with said keeper portion surface so that said door may be opened farther to said fully open position as said stop pin slides along said keeper portion surface toward said second end, said door then being movable back toward said closed position as said stop pin slides back along said keeper portion surface from said second end and over said keeper portion free end to thereby automatically reengage said check strap working surface under the bias of said resilient means.

* * * * *